United States Patent [19]

Meier

[11] 4,265,379

[45] May 5, 1981

[54] CLOSURE ELEMENT OF A SLIDE CLOSURE FOR USE IN LIQUID MELT CONTAINERS

[75] Inventor: Ernst Meier, Wollerau, Switzerland

[73] Assignee: Stopinc Aktiengesellschaft, Zug, Switzerland

[21] Appl. No.: 37,147

[22] Filed: May 8, 1979

[30] Foreign Application Priority Data

May 19, 1978 [DE] Fed. Rep. of Germany ..... 2821839

[51] Int. Cl.[3] ..... B22D 41/08

[52] U.S. Cl. ..... 222/600; 29/157.1 R

[58] Field of Search ..... 29/525, 157.1 R; 403/DIG. 7, DIG. 8, 350, 374, 409; 222/600, 561

[56] References Cited

U.S. PATENT DOCUMENTS

| | | | |
|---|---|---|---|
| 833,409 | 10/1906 | McGuire | 287/DIG. 8 |
| 872,883 | 12/1907 | Adams | 287/DIG. 8 |
| 2,702,732 | 2/1955 | McCarvan | 403/409 X |
| 4,182,466 | 1/1980 | Fehling et al. | 222/600 |
| 4,187,965 | 2/1980 | Alipandi et al. | 222/600 |

OTHER PUBLICATIONS

Wilson et al., *Tool* Engineer's Handbook, 2nd ed., McGraw-Hill, NY 1959, pp. 91-15 thru 91-20.

*Primary Examiner*—David A. Scherbel

*Attorney, Agent, or Firm*—Wenderoth, Lind & Ponack

[57] ABSTRACT

A closure element includes a support frame for supporting a refractory element, for example a plate, of a slide closure for use in liquid melt containers. One or a plurality of eccentrics are mounted on the support frame for detachably fastening the refractory element within the support frame. The refractory element includes a metallic sheath, and the eccentrics include eccentric surfaces bearing directly on the metallic sheath. The eccentrics are positioned such that the eccentric surfaces act on the refractory element both longitudinally thereof and transversely thereof.

12 Claims, 6 Drawing Figures

CLOSURE ELEMENT OF A SLIDE CLOSURE FOR USE IN LIQUID MELT CONTAINERS

BACKGROUND OF THE INVENTION

The present invention relates to a closure element of a slide closure for use in liquid melt containers. More particularly, the present invention relates to such a closure element which includes a refractory element which is subject to wear, for example a slide plate, a base plate, a center plate, an inlet tube or an outlet tube, which is formed of a fireproof refractory material, which is at least partly surrounded by a metallic casing or sheath, and which is supported in a support frame.

Closure elements of this general type are known. For example, German No. DT-OS 27 27 742 discloses an arrangement whereby a refractory element is held within a support plate by means of a wedge-shaped element that may be inserted between a fixed surface and a contact plate which bears against the refractory element with a surface conforming to the configuration of the refractory element.

SUMMARY OF THE INVENTION

With the above discussion in mind, it is the object of the present invention to provide an improved closure element of a slide closure for use in liquid melt containers, wherein the refractory element may be more rigidly secured within the support frame and whereby the refractory element may be more readily inserted into and removed from the support frame.

It is a further object of the present invention to provide such a closure element which is of simpler and less expensive construction than the prior art.

These objects are achieved in accordance with the present invention by the provision of a closure element including a support frame for supporting a refractory element which is subject to wear, and an eccentric arrangement mounted on the support frame for detachably fastening the refractory element within the support frame. Preferably, the refractory element is at least partially surrounded by a metallic sheath, and the eccentric arrangement includes at least one eccentric surface bearing directly on the metallic sheath.

In accordance with a particularly advantageous arrangement of the invention, the refractory element includes an elongated plate having spaced relatively long sides and spaced relatively short sides. The eccentric arrangement may comprise two eccentrics located adjacent one of the relatively short sides, at positions symmetrically on opposite sides of a longitudinal plane which extends centrally of the relatively long sides and transverse to the plane of the plate. Alternatively, the eccentric arrangement may comprise a single eccentric located adjacent one of the relatively short sides, at a position asymmetrical with respect to such longitudinal plane. By these arrangements, the eccentric or eccentrics will maintain the refractory element within the support frame by imparting thereto forces having components extending both in the longitudinal direction of the refractory element and in the transverse direction thereof.

In accordance with a further feature of the present invention, the eccentric includes a disc-shaped eccentric element with a peripheral eccentric surface. Shafts, for example stub shafts, extend axially from opposite sides of the disc-shaped eccentric element. The shafts are rotatably supported within the support frame.

In accordance with an advantageous arrangement of the invention, a lid member is attached to the support frame, and the disc-shaped eccentric element is positioned between the support frame and the lid member. The shafts are rotatably supported, such that one shaft is supported within a recess in the support frame, and a second shaft extends through an opening in the lid member.

The second shaft may have at an outer end thereof a tool receiving head. Alternatively, the second shaft may have therein an axially extending non-circular tool receiving opening. Further, such tool receiving opening may extend entirely through the eccentric, or partially therethrough, with the second shaft not extending outwardly of the lid member. In this latter arrangement, the lateral surfaces of the shafts are entirely bearing surfaces which rotatably support the eccentric.

In accordance with a further feature of the invention, the eccentric surface may have a configuration to impart a self-locking slope to the eccentric. That is, such eccentric surface may be defined by gradually increasing radial distances from the central axis of the eccentric. Thereby, by rotating the eccentric, the eccentric surface gradually presses against the refractory element and becomes wedged or locked thereagainst. To remove the refractory element, it is necessary to again rotate the eccentric.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
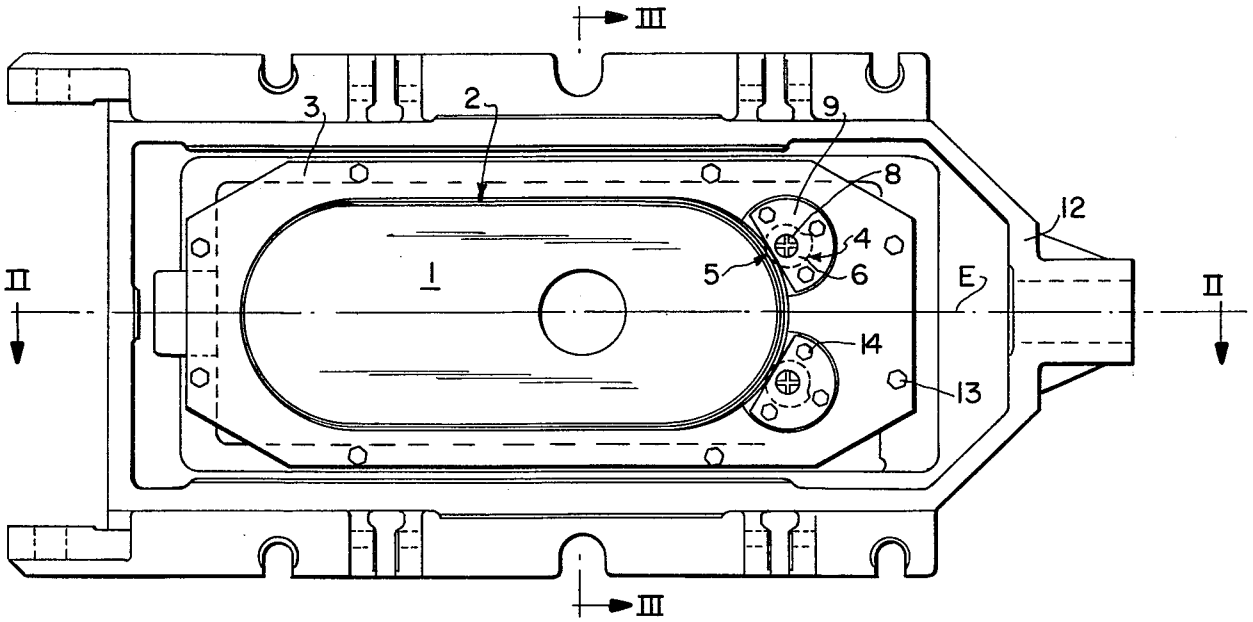
FIG. 1 is a bottom view of a closure element according to the present invention, shown with reference to a base plate of a slide closure.
Figure 2:
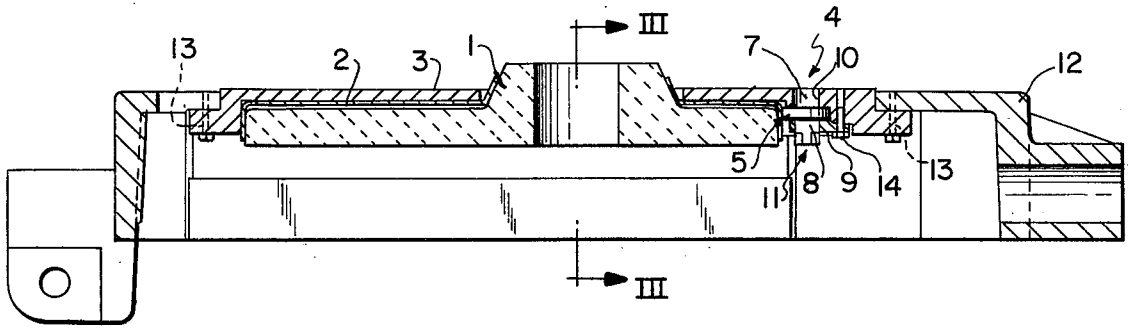
FIG. 2 is a longitudinal section taken approximately along line II—II of FIG. 1.
Figure 3:
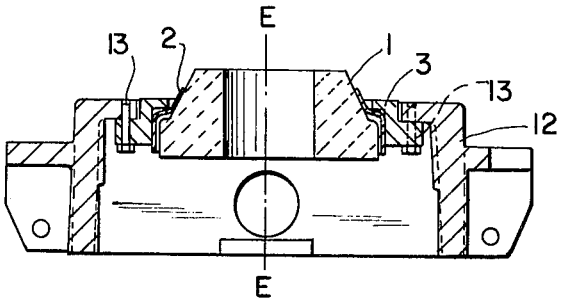
FIG. 3 is a cross-section taken along line III—III of FIGS. 1 and 2.

With reference now to FIGS. 1 through 3 of the drawings, one embodiment of the closure element of the present invention will be described. Specifically, this embodiment of the invention is directed to a closure element including a stationary base plate of a slide closure for closing a spout or opening of a container containing a liquid melt. It is however to be understood that the features of the present invention are equally applicable to closure elements other than the stationary base plate of a slide closure. Specifically, the present invention could equally be directed to the slide plate of a two-plate slide closure or to the central plate or slide plate of a three-plate slide closure.

Base plate 1 is a ceramic element which is subjected to wear during use of the slide closure and operation of the liquid melt container. Accordingly, the base plate 1 must be removably mounted in a support frame 3 of the slide closure. The base plate 1 may have various configurations which are known in the art, but in the illustrated embodiment the base plate 1 is in the form of an elongated plate having spaced relatively long sides and spaced relatively short sides or ends which are symmetrically rounded. Also, the base plate 1 is generally cased within a metallic sheath 2. Base plate and sheath 2 together form a plate member.

The metal support frame 3 is attached to a housing 12 of the slide closure, for example by means of bolts 13.

The refractory plate 1 is mounted within support frame 3 by means of an arrangement of eccentrics, which in the illustrated embodiment includes a pair of eccentrics 4. As shown in FIG. 1, eccentrics 4 are located adjacent one of the relatively short sides of the refractory plate 1, at positions symmetrically on opposite sides of a longitudinal plane E extending centrally of the relatively long sides and transverse to the plane of plate 1. Eccentrics 4 have eccentric surfaces 5 which, upon rotation of eccentrics 4, press against metallic sheath 2, thereby fixedly positioning plate 1 within support frame 3. It will be readily apparent from a consideration of FIG. 1 that the eccentrics 4 impart forces to the plate 1, such forces including components extending longitudinally of plate 1 and components which extend transversely of the longitudinal dimension of plate 1.

Eccentric 4 generally includes a disc-shaped eccentric element 6 having eccentric surface 5 around the periphery thereof. Shafts, for example stub shafts, extend axially from opposite sides of element 6 and are mounted within frame member 3 for rotation about the axis of eccentric 4.

More particularly, in the embodiment of FIGS. 1 and 2 of the drawings, one shaft 7 is mounted for rotation within a recess 10 in support frame 3. The other shaft 8 is mounted within an opening in a lid member 9 which is attached to support frame 3 by means of bolts 14, with element 6 being positioned between support frame 3 and lid member 9. Thus, eccentric 4 is rotatable about the axis thereof, and upon such rotation, the eccentric surface 5 of the eccentric will be pressed with gradually increasing force against sheath 2, thereby fixedly positioning plate 1 within support frame 3.

In the embodiment of FIGS. 1 and 2, second shaft 8 has a head 11 which extends outwardly through lid member 9, head 11 having a non-circular configuration adapted to be engaged by means of a tool, thereby ensuring easy and ready access for selective rotation of eccentrics 4 when it is necessary to remove or insert plate 1 into support frame 3.

Figure 4A:
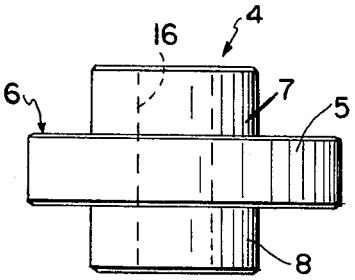
FIGS. 4*a* and 4*b* are enlarged elevation and plan views, respectively, of an alternative arrangement of an eccentric employed in the closure element of the invention.
Figure 4B:
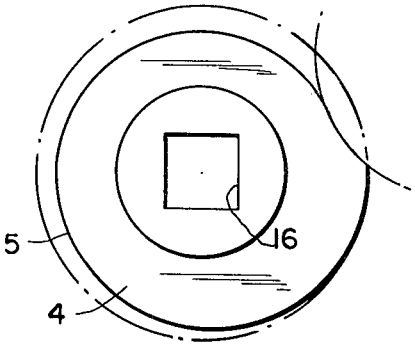

In the eccentric modification shown in FIGS. 4*a* and 4*b* of the drawings, shafts 7 and 8, and particularly shaft 8, are constructed to have lengths which will not extend outwardly from the support frame or the lid member. Thus, in the arrangement of FIGS. 4*a* and 4*b*, shaft 8 does not have head 11 which is shown in FIG. 2. Rather, in the embodiment of FIGS. 4*a* and 4*b*, the eccentric has therein a non-circular opening or bore 16 which extends generally axially of the eccentric and which is configured to receive a tool to impart rotation to the eccentric.

In the above embodiments, and as is particularly illustrated in FIG. 4*b*, the eccentric surface 5 is provided with a self-locking slope. That is, eccentric surface 5 has a configuration which is gradually positioned further from the axis of the eccentric, whereby upon rotation of the eccentric, the eccentric surface 5 will press against the sheath 2 and plate 1 with gradually increasing force until the eccentric is wedged or locked against the sheath and plate. Termination of the rotation of eccentric 4 will result in the eccentric surface being maintained in the locked or wedged position, and cannot be removed therefrom without imparting further rotation, normally in the opposite direction, to the eccentric.

It is to be understood however, that surface 5, rather than having the spiral configuration shown in FIG. 4*b*, may readily be a circular surface defined by the periphery of a circular disc which is mounted eccentrically with respect to shafts 7 and 8.

Figure 5:
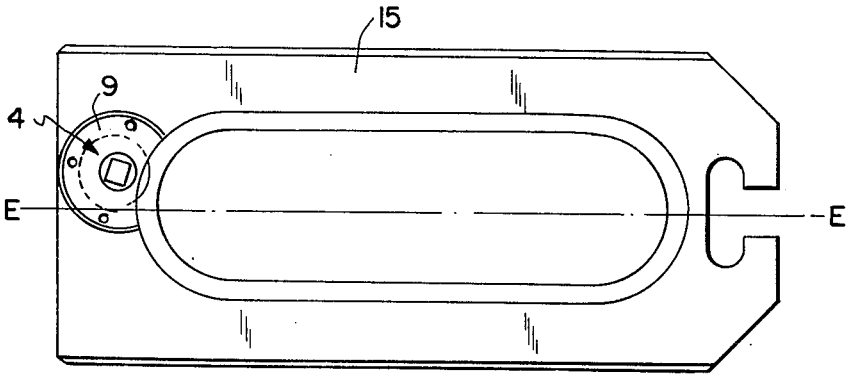
FIG. 5 is a bottom view of an alternative arrangement of the closure element of the present invention, shown with reference to a center plate of a three-plate slide closure.

With reference now to FIG. 5 of the drawings, a further embodiment of the invention will be described, this embodiment being illustrated with respect to a slidable center plate of a three-plate slide closure. In this arrangement, a center plate is adapted to be positioned within a support frame 15 by means of a single eccentric 4 which is located adjacent one of the relatively short sides of the plate, at a position asymmetrically on one side of longitudinal plate E which extends centrally of the relatively long sides of the plate and transverse to the plane of the plate. The embodiment of FIG. 5 is in other respects similar to the embodiment of FIGS. 1 through 3.

In all of the embodiments described above, the eccentric arrangement will impart forces against the refractory plate, such forces including components extending parallel to the longitudinal direction of the plate, and also including components extending transverse to such longitudinal direction. Thereby, the refractory plate is firmly and positively maintained within the support frame. Furthermore, since rotation of the eccentrics is easily achieved, it is quite easy to remove or insert refractory plates from or into the respective support frames.

Although the present invention has been described and illustrated with respect to certain preferred structural arrangements thereof, it is specifically to be understood that various modifications may be made to such structural arrangements without departing from the scope of the present invention.

What I claim is:

1. A closure element of a slide closure for use in liquid melt containers, said closure element comprising:

a plate member including a refractory element which is subject to wear, said plate member having spaced sides and spaced ends;

a support frame for supporting said plate member; and eccentric means, mounted on said support frame, for detachably fastening said plate member within said support frame, said eccentric means comprising at least one eccentric member located adjacent one of said ends of said plate member, at a position offset from a longitudinal plane extending centrally of said sides and transverse to the plane of said plate member, said eccentric member having eccentric surface means, directly bearing on said one end of said plate member, for imparting to said plate member forces including a force component extending parallel to the longitudinal direction of said plate member and a force component extending transverse to such longitudinal direction.

2. A closure element as claimed in claim 1, wherein said plate member further comprises a metallic sheath partially surrounding said refractory element, and wherein said eccentric surface means bears directly on said metallic sheath.

3. A closure element as claimed in claim 2, wherein said plate member comprises an elongated plate, said spaced sides comprise relatively long sides and said spaced ends comprise relatively short ends.

4. A closure element as claimed in claim 3, wherein said eccentric means comprises two said eccentric members located adjacent said one relatively short end, at positions symmetrically on opposite sides of said longitudinal plane.

5. A closure element as claimed in claim 3, wherein said eccentric means comprises only a single said eccentric member located adjacent said one relatively short end, at a position asymmetrical with respect to said longitudinal plane.

6. A closure element as claimed in claim 2, wherein said eccentric member is a disc-shaped eccentric element with a peripheral surface comprising said eccentric surface means and shafts extending axially from opposite sides of said eccentric element, said shafts being rotatably supported by said support frame.

7. A closure element as claimed in claim 6, further comprising a lid member attached to said support frame, said eccentric element being positioned between said support frame and said lid member.

8. A closure element as claimed in claim 7, wherein a first of said shafts is supported within a recess in said support frame, and a second of said shafts extends through an opening in said lid member.

9. A closure element as claimed in claim 8, wherein said second shaft has at an outer end thereof a tool receiving head.

10. A closure element as claimed in claim 8, wherein said second shaft has axially therein a non-circular tool receiving opening.

11. A closure element as claimed in claim 6, wherein said eccentric member has axially extending therethrough a non-circular tool receiving bore.

12. A closure element as claimed in claim 6, wherein said eccentric surface includes a self-locking sloped portion.

* * * * *